US006932096B2

(12) United States Patent
Marek

(10) Patent No.: US 6,932,096 B2
(45) Date of Patent: Aug. 23, 2005

(54) MODIFIED CRUTCH WITH THREE MODE LOWER LEG/FOOT SUPPORT

(76) Inventor: Tessanie Marie Marek, P.O. Box 984, Salado, TX (US) 76572

( * ) Notice: Subject to any disclaimer, the term of this patent is extended or adjusted under 35 U.S.C. 154(b) by 0 days.

(21) Appl. No.: 10/271,339

(22) Filed: Oct. 15, 2002

(65) Prior Publication Data

US 2004/0069336 A1 Apr. 15, 2004

(51) Int. Cl.[7] ..... A61H 3/02

(52) U.S. Cl. ..... 135/68; 135/69; 135/74; 135/84; 623/28

(58) Field of Search ..... 135/65–66, 68–69, 135/74, 79, 84, 73, 76; 623/27–29; 482/67; 297/5–6

(56) References Cited

U.S. PATENT DOCUMENTS 2,771,089 A * 11/1956 Magida ..... 135/69
3,999,565 A * 12/1976 Delacour et al. ..... 135/65
4,141,375 A * 2/1979 Tykwinski ..... 135/66
5,295,499 A * 3/1994 Stutz ..... 135/68
5,524,658 A * 6/1996 Schrader ..... 135/72
5,605,345 A * 2/1997 Erfurth et al. ..... 280/250.1
5,735,303 A * 4/1998 Cole ..... 135/66
6,055,997 A * 5/2000 Greenstadt et al. ..... 135/65
6,206,018 B1 * 3/2001 Daniels, Jr. ..... 135/69
6,386,217 B1 * 5/2002 Cooper et al. ..... 135/74
6,470,900 B1 * 10/2002 Hamilton ..... 135/68

* cited by examiner

*Primary Examiner*—Winnie Yip
(74) *Attorney, Agent, or Firm*—David Henry

(57) ABSTRACT

The present invention relates to an ordinary crutch modified with a straight support which may be formed from a solid, lightweight tubular member, said support connected at one end to near the bottom portion of the crutch and with a bicycle pedal-like cushion on the other end for which the calf, shin or cast of the injured leg or leg of the injured foot rests. Since the pedal can freely revolve from its attachment to the solid support member, the angle at which the leg rests on the pedal relative to the crutch may be readily optimized for the patient's comfort in order to relieve pain and discomfort. Also, fatigue from the body when supporting the dangling leg may be avoided as the leg no longer dangles with its concomitant "dead weight", because the entire weight of the leg is resting on the cushion of the leg support, the knee is flexed or extended while standing, or while sifting. Such an apparatus is easily assembled, does not add any substantial weight to the crutch, and the modification is inexpensive to achieve.

6 Claims, 2 Drawing Sheets

MODIFIED CRUTCH WITH THREE MODE LOWER LEG/FOOT SUPPORT

BACKGROUND OF THE INVENTION

1. Field of the Invention

Applicant's invention relates to a medical apparatus whereby a standard crutch is modified so as to allow the resting of a lower extremity while standing or sitting and thereby reducing discomfort, pain and further injury while facilitating recovery and mobility.

2. Background Information

Crutches are very widely used to assist ambulation in people with various disabilities and of all ages. Depending on the severity of the disability or injury, one may require the use of crutches from a few days to a few weeks or months to an indefinite period of time. Common reasons for the short-term or long-term use of crutches include fracture or sprain of a leg, foot, knee or ankle, post-surgery, arthritis, partial paralysis, accident, sports or occupational injury, etc. And in today's mobile and demanding society, daily and prolonged use of crutches or the need to travel distances with crutches is often times unavoidable.

When using a pair of conventional crutches for support and limited mobility, many people complain of adverse side effects, like underarm soreness, a numbing sensation in the lower arms, back and shoulder fatigue or pain, lower backache, etc. For example, fatigue may be caused by the constant and unintended use of the arms with the aid of the crutches to compensate for the lower body's inability to support the body weight or the unsupported, injured leg. To relieve arm fatigue, one might then chronically lean on the axillary or underarm rests when not walking or moving about in order to support the weight of the injured leg while the injured leg is off the ground. In turn, this will lead to temporary paralysis of the radial nerve, as manifested by underarm soreness and a numbing sensation in the arms. Another consequence of these problems is that they may force the user to use the injured or impaired leg more than necessary, and thus exacerbating the underlying problem.

Nevertheless, keeping weight off the injured extremity is essential to safe crutch walking, promoting effective healing and in avoiding permanent tissue and bone damage. It may also provide some pain relief. At any rate, it often helps to slightly bend the knee. But when one is using crutches, standing for an extended period of time may be unavoidable, which may lead to fatigue, pain, or worse because the body (e.g., the lower back or shoulders) has to constantly compensate for and support the "dead weight" of the impaired and dangling leg. Furthermore, places to sit down are just not always available or convenient. When there are places to sit then there is the problem of how to properly rest the leg with the injury, as resting the injured leg may result in an uncomfortable and painful pressure point from continuous contact with the floor or ground.

In summary, problems and shortcomings associated with the use of standard crutches on their own are sometimes unavoidable. These shortcomings and problems challenge both the short-term and long-term health and safety of the individual and progress or recovery time.

The present invention can reduce the unintended adverse effects of the use of standard crutches, e.g., pain and fatigue, facilitate the healing process and increase the comfort of the user by physically resting the injured leg (with the knee bent or flexed) on the leg support portion of the modified crutch and therefore not requiring the rest of the body, e.g., shoulder, hips and lower back, to compensate for the "dead weight" of the resting unsupported and dangling lower extremity. Such benefits from use of the current invention can be achieved while sitting or standing.

SUMMARY OF THE INVENTION

The problems outlined above are addressed by the present invention, which comprises a simple and novel modification to the crutch to be used on the side of the injury and the other crutch being unmodified. The calf, shin or cast of the injured leg or the leg with the injured foot can be directly placed on the leg support portion of the modified crutch, and thereby reduce patient discomfort, redistribute the extra weight from the shoulders, lower back or hips when an injured leg or foot is freely suspended onto the leg support means, and facilitate the healing process. These benefits can be achieved when the leg support bar of the modified crutch is pointing forward and allowing the calf or cast of the injured leg or foot via an extended knee to rest on the bicycle pedal-like cushion at the end of the support. The same resting benefit can be achieved when the patient is sitting, as the calf or cast can rest on the cushion and relieve the foot of a painful pressure point due to contact with the floor or ground and relieve any other part of the body from holding up the injured leg or foot. Likewise the same benefit can be achieved when the leg support portion of the modified crutch is facing backward and thus allowing the shin or cast of the injured leg or leg of the injured foot to rest on the cushion when the knee is partially bent. In any of the preceding situations, such weight redistribution and support can eliminate or reduce the fatiguing and painful act of supporting a freely-suspended leg or the uncomfortable pressure points associated with supporting a leg on a rigid object, such as a piece of furniture.

It is an object of the present invention to provide a modified and improved crutch which includes a padded leg support means for dynamic support of the user's injured leg, instead of otherwise relying on the lower back, shoulders or hips of the user to support the dangling leg.

It is another object of the present invention to provide additional balance to the standing crutch user by allowing the body to stabilize itself without shifting weight to support the otherwise unsupported leg.

It is another object of the present invention to prevent fatigue to the standing crutch user by resting the leg with the injury on the padded leg support.

It is an object of the present invention to provide a modified and improved crutch for increased comfort level to the user while standing or sitting.

It is an object of the present invention to provide a modified and improved crutch for relief of pain associated with the body supporting the freely-suspended leg of the user while standing or sitting.

It is yet another object of the present invention to provide a limitless number of angles that the resting leg can have relative to the crutch while standing or sitting.

The advantages of the present invention will be further appreciated from the drawings and from the detailed description provided below.

DETAILED DESCRIPTION OF THE PREFERRED EMBODIMENT

The current invention may be used immediately by any one with an injury to the right lower extremity or the left lower extremity, with or without a cast, without the necessity of dismounting and remounting any portion of the apparatus to accommodate a left leg or a right leg impairment. Depending upon the needs and desires of the user, the leg support provided by the current invention may be used while the user is standing still or sitting. It is contemplated that the user will use a conventional (non-modified) crutch for the non-injured side.

Figure 1:
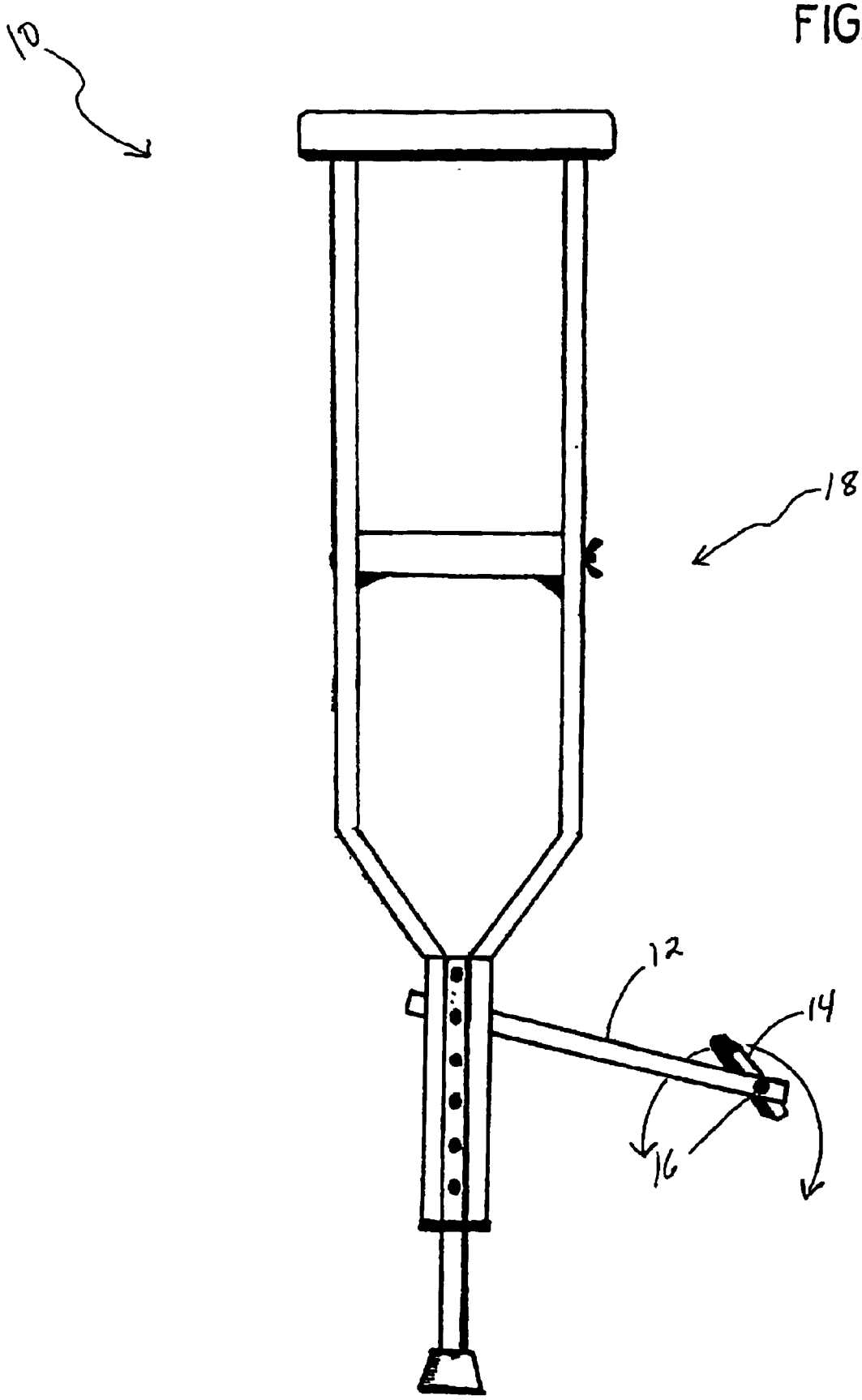
FIG. 1 is a front view of a pair of crutches inserted into a crutch sling assembly in accordance with this invention.

Referring now to the drawings, wherein like reference numerals designate identical or corresponding parts throughout the several views, and more particularly to FIG. 1 thereof, there is shown a crutch assembly 10 including a leg support frame member 12 and a rotatable leg support 14 attached to a crutch frame 18 such as is commonly used by patients with injuries to a lower extremity.

In FIG. 1 leg support frame member 12 is a solid, straight, lightweight bar and may be made of a material that is known per se and is preferably made of aluminum because of its light weight and sturdiness. One end of member 12 is rigidly fixed or attached to the lower portion of crutch frame 18. Since the size of each pair of crutches should be fitted for the individual user, in the preferred embodiment one end of member 12 is rigidly affixed to crutch frame 18 to be used on the side of the injury at a point approximately 32% up from the bottom of crutch frame 18. In the preferred embodiment, the angle at which member 12 intersects with crutch frame 18 is approximately 60 degrees. The core of leg support 14 is rigidly fixed to the distal end of member 12. Axle member 16, shown at its attachment point only, allows leg support 14 to act as a freely-revolving pedal-like support. In the preferred embodiment the length of member 12 is approximately fourteen inches. Leg support 14 may be made of a material that is known per se and is preferably made of a reinforced, padded and woven fabric. In the embodiment shown, a bicycle pedal assembly is used for convenience and ease of construction.

Whether member 12 and leg support 14 assembly is pointed in a forward or backward direction and because the leg support means does not add substantial weight to the modified crutch, the modification will not interfere with a user while walking or standing, whether the leg is resting on the leg support means or not. Even though member 12 is fixed, the fact that leg support 14 is freely-revolving provides unlimited pivoting motion to accommodate and allow resting of the leg regardless of the angle at which the crutch assembly 10 makes contact with the ground. Therefore, leg support 14 can conform immediately to any angle in which the shin, calf or cast makes contact while the leg rests and the body is thus relieved from supporting the injured and dangling leg. The enhanced comfort for the user also prevents the body and muscles from fatiguing or cramping.

Figure 3:
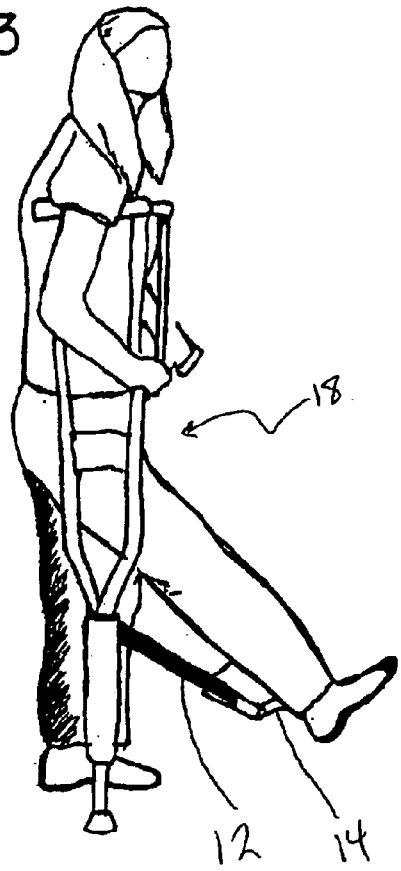
FIG. 3 is a perspective view of the modified crutch being used as an elevated support for a patient's leg when standing with knees partially bent.

One mode of use of the current invention will now be described with reference to FIG. 3. With member 12 pointed forward, the user has elected to rest the calf or cast while standing with the knee flexed. Note how the weight of the injured leg or leg with the injured foot has been fully transmitted from the body's lower back, hip and/or shoulder (as in the situation with a standard crutch) to leg support 14 and member 12, and thereby increasing user comfort, decreasing user pain and facilitating the healing process.

Figure 2:
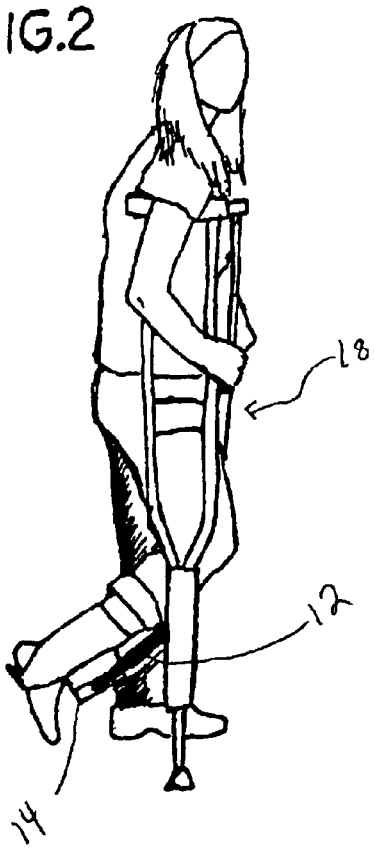
FIG. 2 is a perspective view of the modified crutch being used as an elevated support for a patient's leg when standing with knees extended.

Another mode of use of the current invention will now be described with reference to FIG. 2. With member 12 and leg support 14 pointing backward, the user has elected to rest the shin or cast while standing with the knee partially bent. Note how the weight of the injured leg or leg with he injured foot has been fully transmitted from the body's lower back, hip and/or shoulder (as in the situation with a standard crutch) to leg support 14 and member 12 and thereby increasing user comfort, decreasing user pain and facilitating the healing process.

Figure 4:
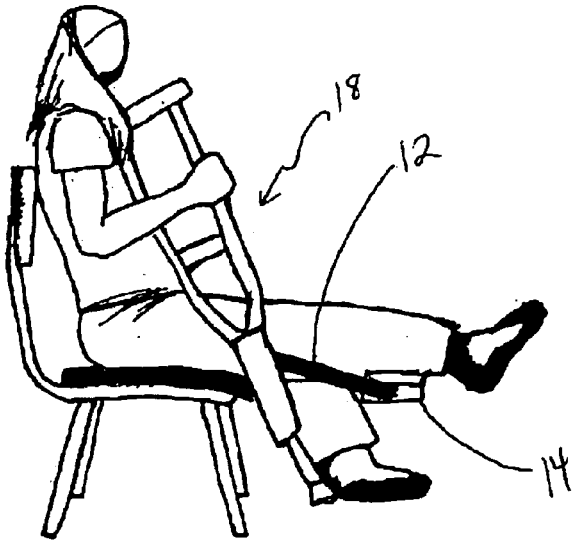
FIG. 4 is a perspective view of the modified crutch being used as an elevated support for a patient's leg when sitting with knees extended.

Yet another mode of use of the current invention will now be described with reference to FIG. 4. With the bar pointed forward, the user has elected to rest the calf or cast on the leg support (and not making contact with the floor or ground) while sitting with the knee flexed. Note how the weight of the injured leg or leg with the injured foot has been transmitted from the body's lower back, hip and/or shoulder to leg support 14 and member 12, and thereby increasing user comfort, decreasing user pain and facilitating the healing process. Also, resting the calf or cast on leg support 14 while sitting preempts the foot awkwardly and uncomfortably resting on the ground or floor, which could otherwise create painful pressure points.

From the disclosure and descriptions of the invention shown or described herein, it can be appreciated that a crutch modified to allow resting of an injured foot or leg (and thus eliminating the need for the lower back, hips or shoulders to constantly compensate for the full weight of the unsupported leg) while the user is standing or sitting is possible, desirable and therapeutic by a simple modification of a crutch. Although the present invention has been disclosed in connection with specific embodiments, it will be apparent to those skilled in the art that variations from the illustrated embodiments may be undertaken without departing from the spirit and scope of the invention. It is intended that the following claims cover all equivalent modifications and variations as fall within the scope of the invention.

I claim:

1. A crutch assembly comprising:

a crutch frame configured to reversibly mate with a leg support frame member;

said crutch frame having a vertical member, said leg support frame member having a proximate end and a distal end, wherein said leg support frame member is reversibly connected with said vertical member of said crutch frame at said proximate end to allow reversibly attaching the leg support frame member in front and back opposite directions with respect to said vertical member of said crutch frame about an axis where said crutch frame and said leg support frame are joined; and a rotateable leg support, wherein said leg support is rotateably connected with said leg support frame member at said distal end to allow free rotation of said legs support with respect to said legs support frame member about an axis where said legs support frame member and said legs support are joined, and to allow said leg support to move in orbital fashion about said crutch frame.

2. The crutch assembly of claim 1 wherein said leg support frame member and said crutch frame are configured for mutual, reversible attachment in a plurality of relative configurations, whereby said rotateable leg support is positionable in a plurality of positions relative to said leg support frame member.

3. The crutch assembly of claim 2 further comprising a padding member attached to said rotateable leg support.

4. The crutch assembly of claim 2 further comprising an axle member wherein said rotateable leg support is rotateably connected to said leg support frame member by receiving said axle member extending from said leg support frame member.

5. The crutch assembly of claim 1 further comprising an axle member wherein said rotateable leg support is rotateably mated with said leg support frame member by receiving said axle member extending from said leg support frame member.

6. The crutch assembly of claim 1 further comprising a padding member attached to said rotateable leg support.

* * * * *